US005330307A

United States Patent [19]

Spiers et al.

[11] Patent Number: 5,330,307

[45] Date of Patent: Jul. 19, 1994

[54] PLASTICS COMPACTOR FOR MOBILE EQUIPMENT

[75] Inventors: Kent Spiers, Caledonia, Miss.; Philip E. Carr, Clearfield, Pa.

[73] Assignee: Marathon Equipment Company, Vernon, Ala.

[21] Appl. No.: 16,941

[22] Filed: Feb. 12, 1993

[51] Int. Cl.[5] ..... B65B 21/02

[52] U.S. Cl. ..... 414/406; 414/409; 414/517

[58] Field of Search ..... 414/406, 407, 408, 409, 414/517, 525.3, 525.6

[56] References Cited

U.S. PATENT DOCUMENTS

| | | | |
|---|---|---|---|
| 3,207,344 | 9/1965 | Clar | 414/409 |
| 3,490,631 | 1/1970 | Smith | 214/503 |
| 3,955,694 | 5/1976 | Herpich | 214/82 |
| 4,057,010 | 11/1977 | Smith | 100/50 |
| 4,096,956 | 6/1978 | Gaskin | 214/82 |
| 4,113,125 | 9/1978 | Schiller | 414/525.6 X |
| 4,557,658 | 12/1985 | Lutz | 414/517 |
| 4,830,436 | 5/1989 | Sockwell et al. | 298/8 R |
| 4,840,531 | 6/1989 | Dinneen | 414/409 |
| 4,877,366 | 10/1989 | De Filippi | 414/517 |
| 4,913,301 | 4/1990 | Pickler | 414/407 X |
| 4,979,866 | 12/1990 | Croy | 414/517 |
| 5,074,737 | 12/1991 | Pellegrini et al. | 414/406 |
| 5,123,801 | 6/1992 | O'Daniel | 414/517 X |

FOREIGN PATENT DOCUMENTS

| | | | |
|---|---|---|---|
| 0048981 | 7/1911 | Austria | 414/406 |
| 0274131 | 3/1930 | Italy | 414/406 |
| 0647277 | 12/1950 | United Kingdom | 414/406 |

*Primary Examiner*—James R. Bidwell

*Attorney, Agent, or Firm*—Joseph W. Berenato, III

[57] ABSTRACT

A container for compacting refuse is provided. The compacting container is mounted transversely to the elongated bed of a refuse collection vehicle. Refuse is deposited into the compacting container through a first refuse inlet located in a first end of the compacting container along one side of the truck and through a second refuse inlet located in the top of the compacting container via a pivotally mounted basket located on the second end of the container and which is operated by a hydraulic or pneumatic cylinder. The compacting container is discharged through a pivotally mounted door located on the same end of the container as the basket. An automatic latch keeps the door closed during compaction of the refuse.

19 Claims, 5 Drawing Sheets

FIG. 3
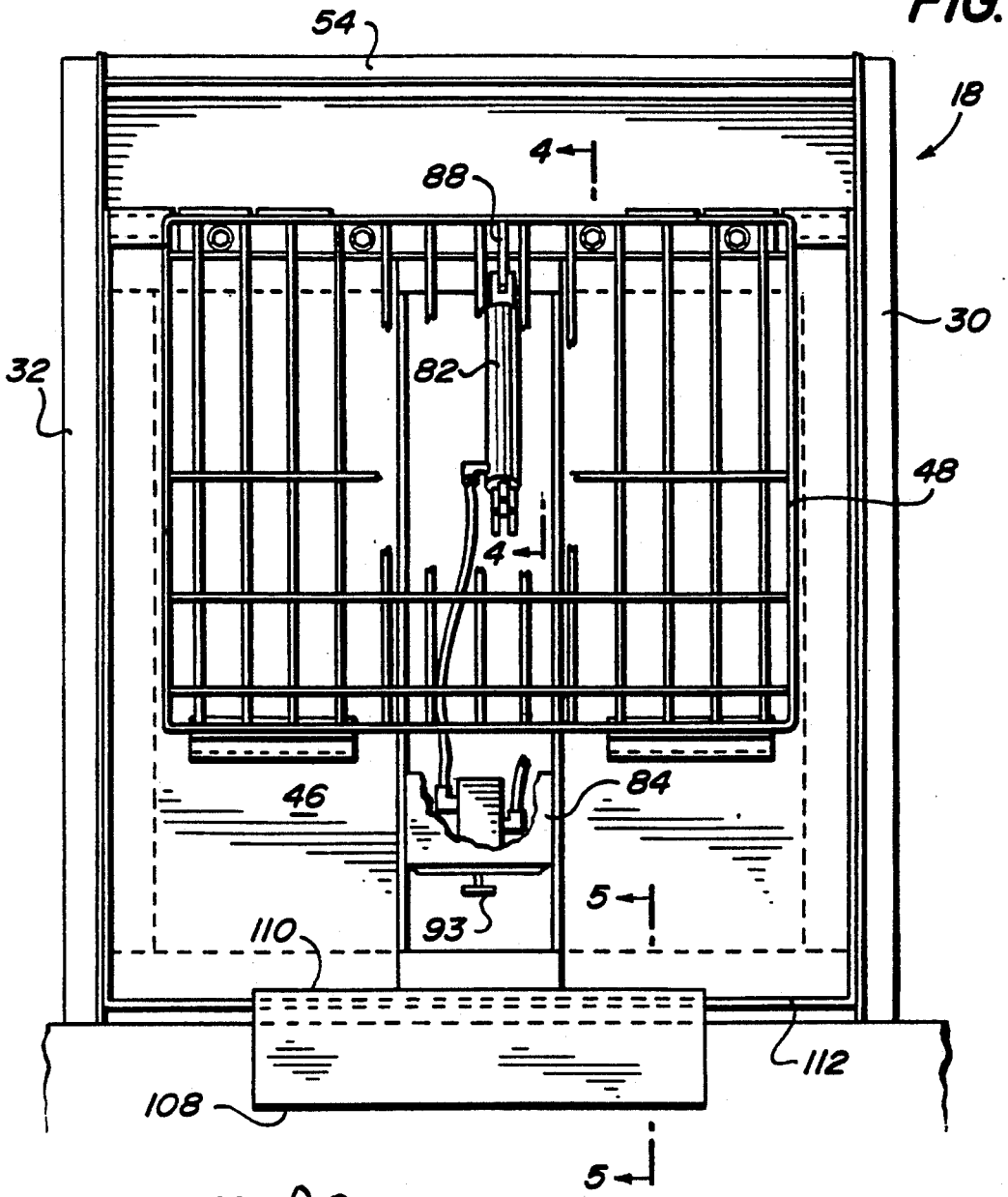
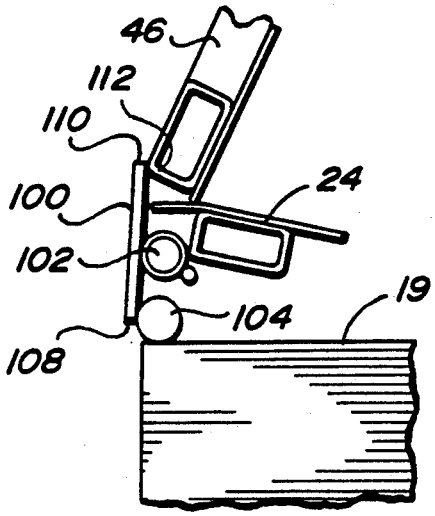
FIG. 5

PLASTICS COMPACTOR FOR MOBILE EQUIPMENT

FIELD OF THE INVENTION

The present invention relates to vehicles having containers for the collection and compaction of recyclable refuse.

BACKGROUND OF THE INVENTION

Refuse recycling has become an important way to ensure efficient use of world resources and to slow the growth of landfills. One aspect to efficient recycling is refuse segregation, whereby different types of materials, e.g. plastic, metal, and paper, are separated prior to processing of the old material into new. In this regard, many communities have opted for source separation, whereby homeowners and businesses segregate the materials prior to collection. Source separation requires a collection vehicle suited to maintaining separation of refuse. A particular problem exists with collection of plastic refuse, because of the large volume plastics take up compared to glass, paper and metal.

Collection vehicles have been proposed for the collection of recyclable refuse in communities where source segregation is employed. In general, a vehicle has separate containers for each type of refuse collected. In addition, these vehicles generally provide inlets into the containers through which workers deposit the refuse, and a door for discharge of the collected refuse.

With regard to collecting plastic material for recycling, a compacting ram for compacting the plastic collected may be provided. Compaction increases the mass of plastic that can be collected before emptying the container becomes necessary.

Competing design requirements for these compacting containers include the capability to deposit refuse into the container from either side of the thoroughfare on which the vehicle is being driven, large interior volume particularly for plastic refuse, large discharge area to allow complete emptying of the container, and a locking mechanism for the discharge door.

While prior art devices have provided some solutions to the above-mentioned requirements, there still exists a need in the art to fulfill all of these requirements in a single compacting container.

SUMMARY OF THE INVENTION

Generally speaking, this invention fulfills the above-described needs in the art by providing a mobile system for the collection of recyclable refuse which comprises a vehicle, a hollow container mounted to said vehicle, a first refuse inlet disposed in an end of the container for depositing refuse therethrough, a second refuse inlet disposed in the top of the container for depositing refuse therethrough, a basket pivot secured to said container adjacent an edge of said second refuse inlet, and a basket secured to said basket pivot for depositing refuse through said second refuse inlet.

A vehicle for collection of recyclable refuse comprises a longitudinally extending bed, a plurality of containers transversely mounted to the bed, one of the refuse containers being a compacting container which includes a hollow body having a top, first and second sides, first and second ends and a segmented interior defining a refuse deposit area and a refuse compaction area, compactor means located within the body of the one container for transferring refuse from the refuse deposit area into the refuse compaction area and for causing compaction thereby, a discharge door which is pivotally secured to the second end of the container body, a curbside refuse inlet disposed in the first end of the body, a second refuse inlet disposed in the top adjacent to the second end and a basket which is cooperatively and pivotally secured to the discharge door for dumping refuse into the roof refuse inlet.

In the preferred embodiment of the invention, an automatic latch is provided along the intersection of the discharge door and the floor for maintaining the door in a closed position. The automatic latch includes a pivoting plate secured to the bottom of the container and a stop bar secured to the lift frame of the container. When discharge of the compacting container is required, an hydraulic or pneumatic piston, located under the compacting container, is actuated, thereby causing the first end of the container to be rotatably raised above the second end. This rotation of the container results in the latch plate losing contact with the stop bar. The latch plate is then free to rotate and the discharge door opens under the weight of the refuse. As the container is lowered back to its rest position, the latch plate contacts the stop bar and is thereby caused to rotate back to its locking position. As the latch plate rotates, it contacts the discharge door. When the latch plate contacts both the discharge door and the stop bar, the latch plate cannot rotate and the discharge door is locked in the closed position.

The invention will now be described in detail and with regard to the accompanying drawings.

BRIEF DESCRIPTION OF THE DRAWINGS

FIG. 3 is an enlarged, fragmentary, elevational view, with portions broken away for clarity, of the compacting container.

FIG. 5 is a fragmentary, cross-sectional view of the automatic latch along line 5—5 of FIG. 3.

DETAILED DESCRIPTION OF THE INVENTION

Figure 1:
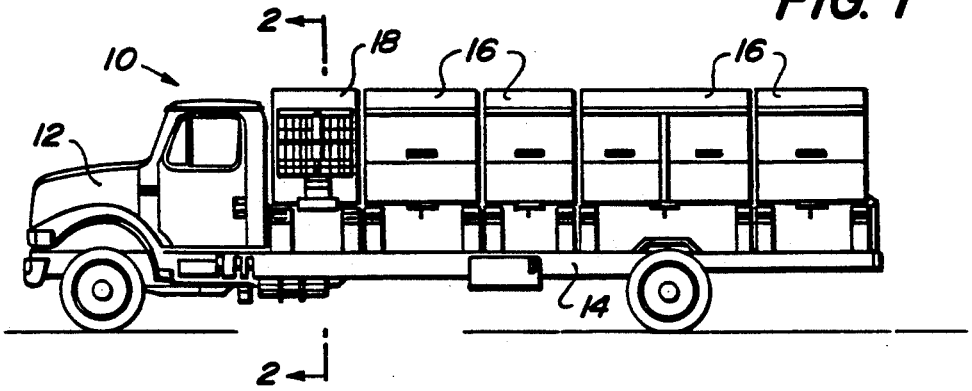
FIG. 1 is a side elevational view of a refuse collection vehicle having several refuse containers and the compacting container of the present invention mounted thereto.

With reference now to FIG. 1, a mobile system for the collection of recyclable refuse is shown generally at 10. System 10 includes vehicle 12 having longitudinally extending bed 14 and containers 16 and 18 mounted thereto in longitudinally spaced relation. Containers 16 and 18 extend transversely to bed 14.

Each of containers 16 and 18 would normally be designated to hold one type of recyclable refuse, i.e.

plastic, paper, metal, glass, etc. Container 18, having means for tompatting the refuse deposited therein, is the subject of the present invention.

Figure 2:
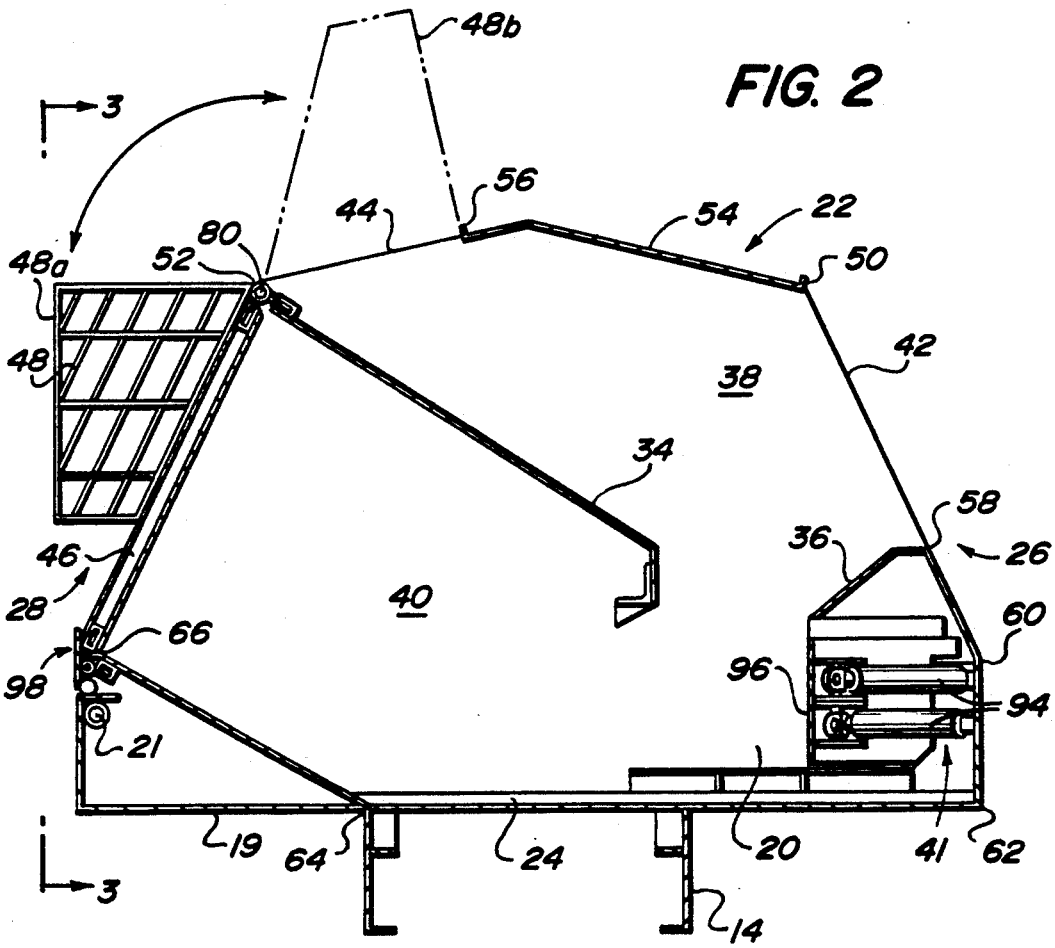
FIG. 2 is a fragmentary, cross-sectional view of the compacting container, taken along line 2—2 shown in FIG. 1 and viewed in the direction of the arrows.

In order that compacting container 18 be pivotally mounted on vehicle 12, compacting container 18 includes a lift frame 19 secured to bed 14 as is best shown in FIG. 2. Lift frame 19 includes dump pivot 21 to which compacting container 18 is secured. The axis of dump pivot 21 runs parallel to bed 14. The pivotal mounting of compacting container 18 to vehicle 12 facilitates its emptying.

As best shown in FIGS. 2 and 3, container 18 has hollow body 20 with top portion 22, floor 24, first end 26, and second end 28. FIG. 3 illustrates first side 30 and second side 32 which extend between ends 28 and 26.

Referring now to FIG. 2, the interior of compacting container 18 is segmented by interior walls 34 and 36 into refuse deposit area 38 and refuse compaction area 40. Walls 34 and 36 extend at a steep angle to prevent refuse from becoming stuck thereon. Refuse is deposited into deposit area 38 through curbside refuse inlet 42 and roof refuse inlet 44. Deposited refuse is then transferred from deposit area 38 into compaction area 40 and compacted therein by compactor unit 41 located within body 20 below wall 36. Compacted refuse is discharged through discharge door 46 located in second end 28.

Efficient collection of recyclable refuse requires the ability to deposit refuse in compacting container 18 from either side of vehicle 12. To this end, curbside refuse inlet 42 is located in first end 26. However, because discharge door 46 encompasses the full extent of second end 28 requiring placement of roof refuse inlet 44 in top portion 22, dumper basket 48 has been provided at second end 28 for depositing refuse through roof refuse inlet 49.

As best shown in FIG. 2, top portion 22 runs from first end top edge 50 to second end top edge 52 and includes roof 54 and the opening of roof refuse inlet 44, leading into refuse deposit area 38. Roof 54 extends from first end top edge 50 to roof edge 56 intermediate the length of compacting container 18. Roof refuse inlet 44 extends the balance of the length of compacting container 18 from roof edge 56 to second end top edge 52. By way of example and not of limitation, a peaked roof is shown in FIG. 2; roof 54 could, however, be flat or curved. It can be seen in FIG. 3 that roof 54 extends the full width of compacting container 18 from first side 30 to second side 32.

Curbside refuse inlet 42 extends from first end top edge 50 to upper edge 58 of wall 60. Further, refuse inlet 42 is positioned at a height which allows the refuse collector to deposit refuse into compacting container 18 while standing alongside vehicle 12.

Floor 24, as best shown in FIG. 2, extends from first end bottom edge 62 in substantially planar fashion to point 64 intermediate the length of compacting container 10. Floor 24 is bent upward at 64 and extends to second end bottom edge 66. Floor 24 extends the full width of compacting container 18 from first side 30 to second side 32.

Figure 8:
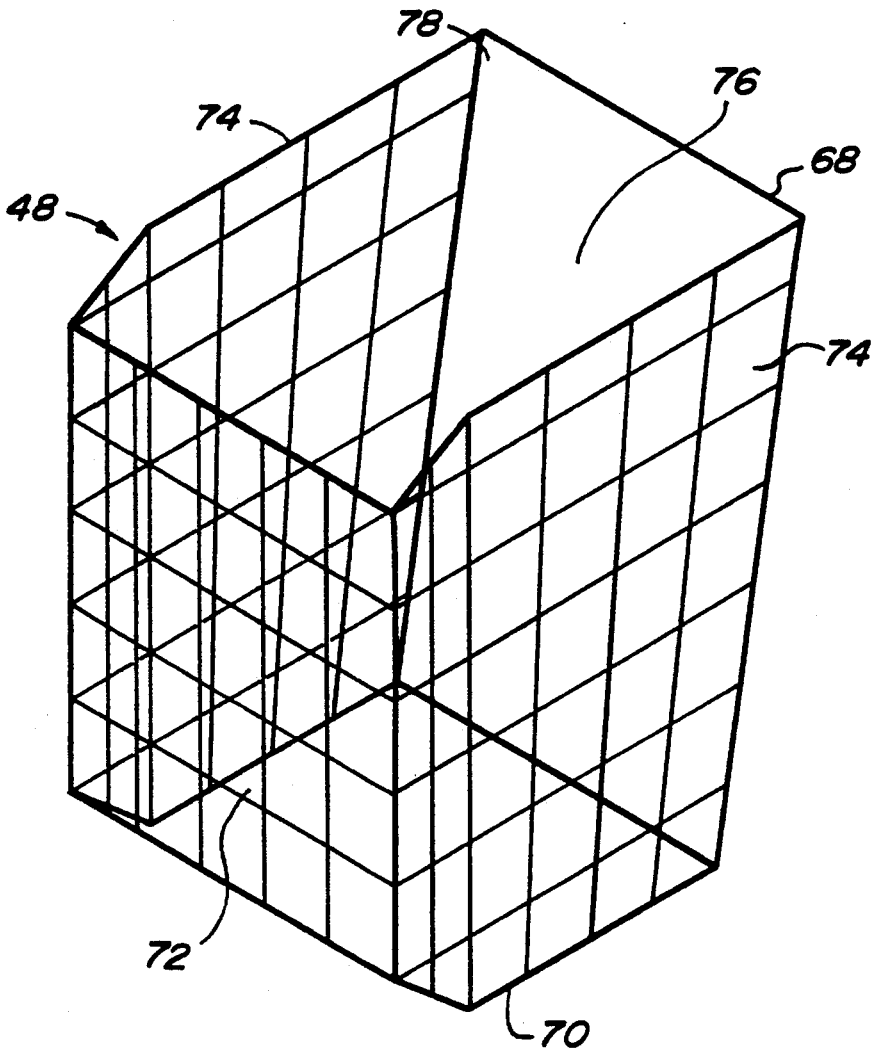
FIG. 8 is a perspective view of the dumper basket.

Basket 48, as best shown in FIG. 8, is constructed from wire and sheet metal. Back 68, which is against door 46 during collection, and bottom 70 are constructed from sheet metal. Front 72 and sides 74 are constructed from wire to form a mesh through which the operator can see. As best shown in FIG. 8, the opening 76 in basket 48 extends from top 78 down a portion of front 72. When hanging on container 18 in the collection position **48*a* illustrated in FIG. 2, opening 76 is at a height sufficient to allow the operator to easily dump plastic refuse therein from a standing position alongside vehicle 12**.

Figure 4:
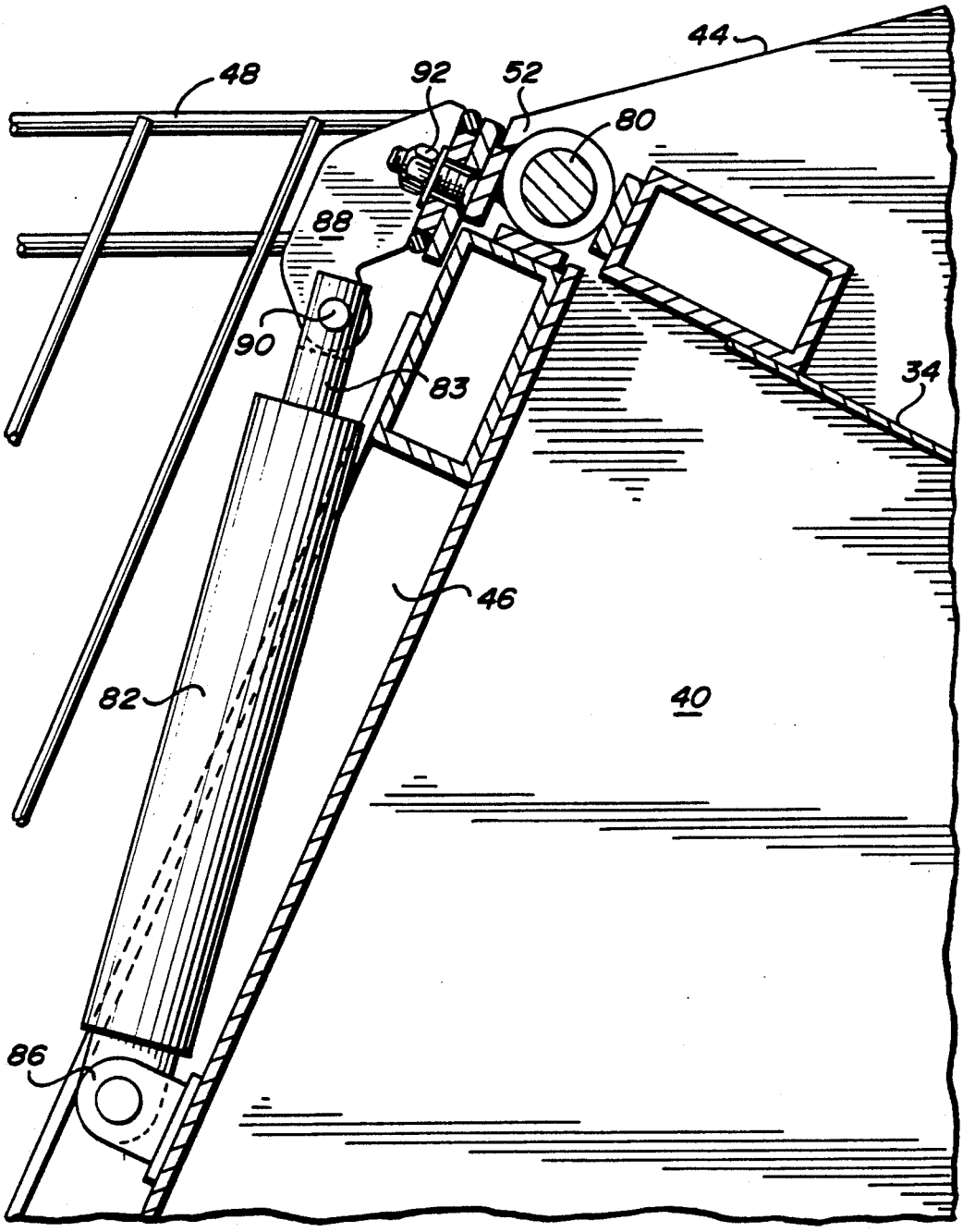
FIG. 4 is a fragmentary, side elevational view of the dumper basket mechanism of FIG. 3 taken along the line 4—4 and viewed in the direction of the arrows.

Dumper basket 48 and discharge door 46 are pivotally hung from fixed pivot 80 in a cooperative manner as shown in FIGS. 2, 3 and 4. In this way, dumper basket 48 is operable without cooperative movement of discharge door 46. However, when first end 26 of compacting container 18 is raised for discharging refuse through discharge door 46, then dumper basket 48 cooperatively swings to permit compacting container 18 to be opened.

The cooperative fixed pivot 80 and the connection of dumper basket 48 to discharge door 46 are best shown in FIGS. 3 and 4. Referring to FIG. 3, compacting container 18, dumper basket 48, basket cylinder 82 and basket cylinder actuation control unit 84 are shown.

With reference now to FIG. 4, the linkage connecting dumper basket 48 to basket cylinder 82 is shown. Basket cylinder 82 is pivotally secured to discharge door 46 at fixed pivot mount 86. The opposite end of basket cylinder 82 is pivotally secured to dumper basket 48 via link 88. Link 88 is pivotally secured to cylinder 82 by pin 90 and is fixedly secured to basket 48 by bolt 92. Actuation of basket cylinder 82, by depressing and holding palm button 93 of FIG. 3, causes extension of piston 83 and, thereby, rotation of dumper basket 48 about pivot 80, from collection position **48*a* to deposit position 48*b* as shown in FIG. 2. Refuse contained therein is thus deposited into refuse deposit area 38 through roof refuse inlet 44. By releasing palm button 93, dumper basket 48 is returned to collection position 48*a* by retraction of piston 83**.

Compactor unit 41 consists of two cylinder and piston assemblies 94 arranged in a crossed manner and connected to ram 96. The crossed-cylinder arrangement provides a compactor unit 41 having a long stroke but a relatively short retracted profile. Upon actuation, compactor ram 96 forces refuse in refuse deposit area 38 into compaction area 40. As compaction area 40 fills with refuse, introduction of more refuse will cause compaction of the refuse contained therein, thereby allowing continued introduction of additional refuse. When further compaction of the refuse is not possible, vehicle 12 goes to a processing site where compacting container 18 is emptied as discussed below. Because compaction forces refuse against pivotally hung discharge door 46, automatic latch 98 is provided along second end bottom edge 66 to keep discharge door 46 closed during compaction.

Automatic latch 98 is best shown in FIG. 5. Automatic latch 98 takes the form of a latch plate 100 which is secured via latch plate pivot 102 to floor edge 66. Also provided is latch stop 104 which is secured to lift frame 19. The operation of automatic latch 98 will be discussed in greater detail below.

Figure 6:
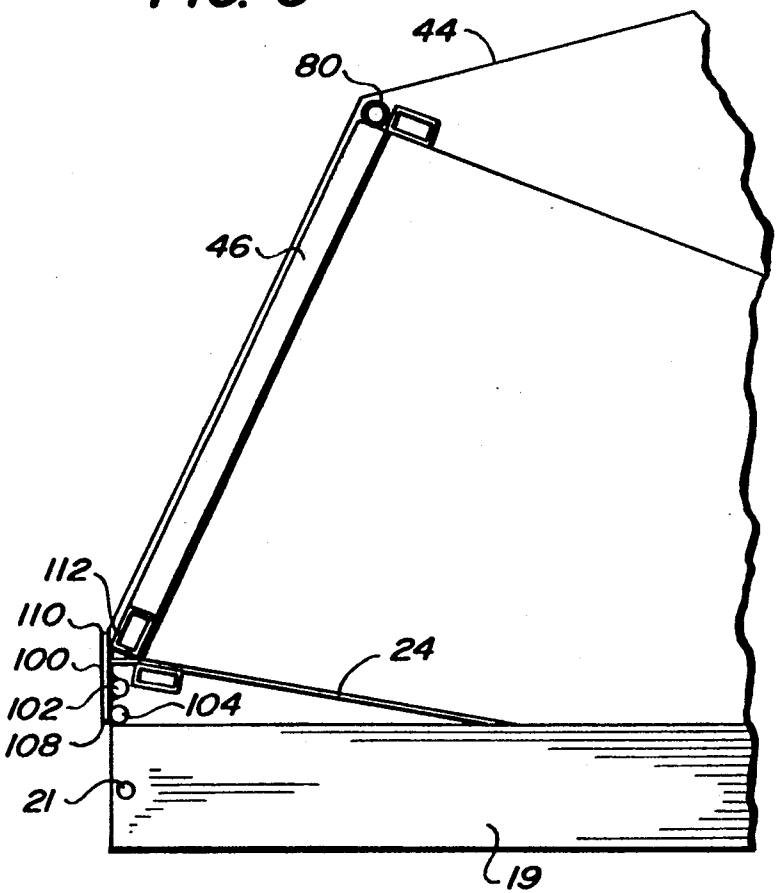
FIG. 6 is a fragmentary, cross-sectional view of the compacting container showing the discharge door in the closed position.

FIG. 6 illustrates compacting container 18 in its collection position with discharge door 46 closed and locked by automatic latch 98. In this position, with latch plate 100 in a generally vertical position, lower edge 108 of latch plate 100 contacts stop 104 while upper edge 110 of latch plate 100 simultaneously contacts lower edge 112 of discharge door 46. In this position, latch plate 100 is not free to rotate about pivot 102 and discharge door 46 will not open under the pressure due to compaction of refuse.

Figure 7:
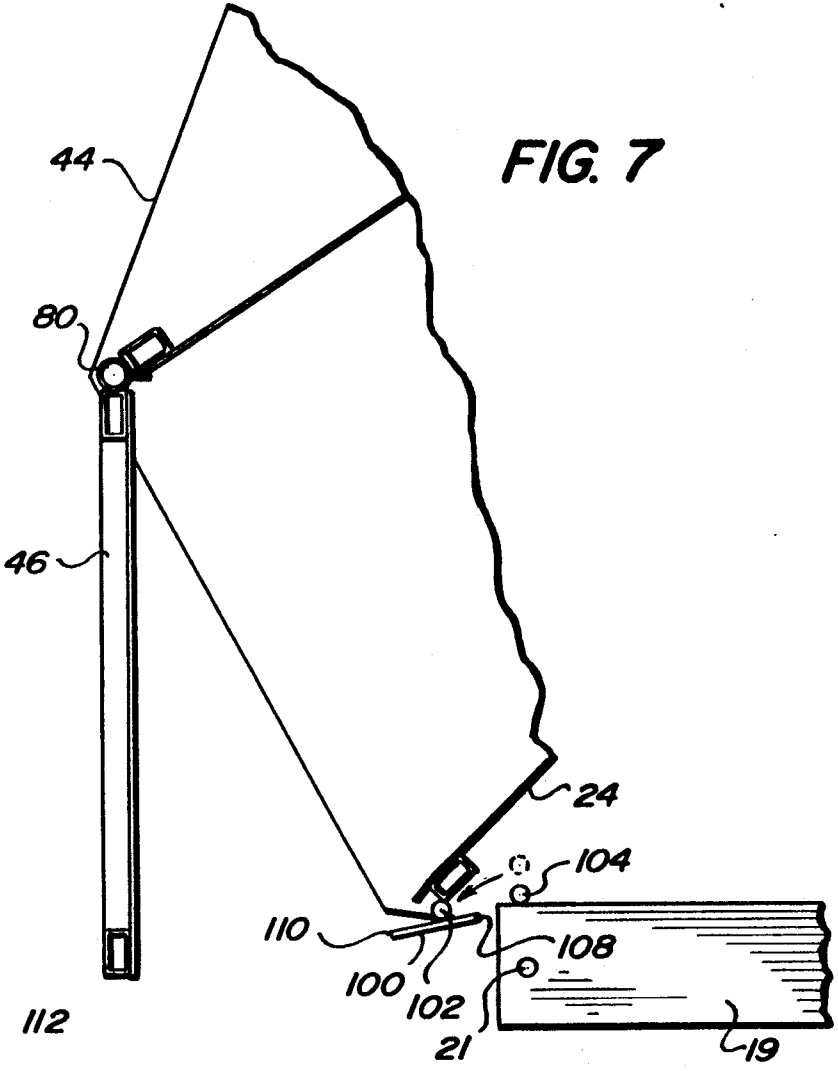
FIG. 7 is a fragmentary, cross-sectional view of the compacting container showing the discharge door in the open position.

When discharge of compacting container 18 is desired, an hydraulic or pneumatic cylinder, not shown in the figures, and which is located beneath compacting container 18, is actuated, thereby causing rotation of compacting container 18 about dump pivot 21. As compacting container 18 rotates, latch plate 100 translates away from stop 104. Because latch plate 100 no longer contacts both discharge door 46 and stop 104, latch plate 100 is free to rotate about pivot 102, and discharge door 46 opens as shown in FIG. 7.

As compacting container 18 is rotated back to the collection position shown in FIG. 6, the lower edge 108 of latch plate 100 contacts latch stop 104 thereby causing latch plate 100 to rotate back to its generally vertical position. As latch plate 100 rotates and as discharge door 46 closes, upper edge 110 of latch plate 100 contacts lower edge 112 of discharge door 46, further urging discharge door 46 to its closed and locked position.

Given the above disclosure, many other features, modifications and improvements will become apparent to those skilled in the art. Such other features, modifications and improvements are, therefore, considered to be a part of this invention, the scope of which is to be determined by the following claims.

I claim:

1. A mobile system for collection of recyclable refuse, comprising:

a vehicle;

a hollow container mounted transversely to said vehicle, said container having a top and laterally spaced first and second ends;

a first refuse inlet disposed in one of said first and second ends for depositing refuse therethrough into said container;

a second refuse inlet disposed in said top for depositing refuse therethrough into said container;

an opening to said container in the other one of said ends;

a discharged door pivotally secured to said container for selectively closing said opening; and a basket pivotally secured to said container proximate said top for depositing refuse into said container through said second refuse inlet.

2. The system of claim 1 wherein said basket is constructed from wire mesh.

3. The system of claim 1 further comprising compaction means for tompatting refuse deposited within said container.

4. The system of claim 1 wherein said container is pivotally mounted to said vehicle.

5. The system of claim 4 further including an automatic latch for locking said discharge door in a closed position said latch including a stop bar secured to said vehicle and a latch plate pivotally mounted to said container and having an upper edge and a lower edge, so that said door is locked in a closed position when said lower edge contacts said stop bar while said upper edge simultaneously contacts said door.

6. The system of claim 3 wherein a plurality of interior walls are positioned within said container for defining a refuse deposit area and a refuse compaction area.

7. The system of claim 6 wherein said compactor means is operatively aligned to transfer refuse from said deposit area into said compaction area and for causing compaction thereof.

8. The system of claim 1 wherein said container further comprises a peaked roof.

9. The system of claim 1 wherein said basket includes means for causing rotation thereof, comprising:

a link having first and second end portions; and a cylinder and piston assembly having first and second ends wherein said first end is pivotally secured to said door and said second end is pivotally secured to said first end portion and said second end portion is secured to said basket.

10. A vehicle for collection of recyclable refuse, comprising:

a longitudinally extending bed;

a plurality of refuse containers transversely mounted, to said bed;

one of said refuse containers being a compacting container, said compacting container including a hollow body having a top, a bottom, first and second sides, first and second ends, and a segmented interior defining a refuse deposit area and a refuse compaction area;

compactor means within said body for transferring refuse from said deposit area into said compaction area and causing compaction thereof;

a discharge door pivotally secured to said body at said second end;

a curbside refuse inlet disposed in said first end;

a roof refuse inlet disposed in said top adjacent said second end; and a basket cooperatively and pivotally secured to said door for dumping refuse into said roof refuse inlet.

11. The vehicle of claim 10, wherein said top includes a peaked roof.

12. The vehicle of claim 10, further comprising a lift frame secured to said bed and a dump pivot secured to said lift frame wherein said compacting container is secured to said dump pivot.

13. The vehicle of claim 12, further comprising:

an automatic latch disposed along the intersection of said door to said bottom for maintaining said door in a closed position, said latch including a latch plate pivotally secured to said bottom and a stop bar secured to said lift frame and wherein said door is locked in a closed position when said latch plate simultaneously contacts said stop bar and said door.

14. The vehicle of claim 10, wherein said basket includes pivot means comprising:

a link having first and second ends;

a piston having first and second ends; and wherein said piston first end is pivotally secured to said door, said piston second end is pivotally secured to said link first end, and said link second end is secured to both said basket and said basket pivot so that actuation of said piston causes said basket to rotate.

15. The vehicle of claim 10, wherein said compactor means is disposed at said first end of said body in operative alignment with said refuse deposit area and said refuse compaction area.

16. The vehicle of claim 8, wherein said first refuse inlet is disposed above said compactor means.

17. A system for collection of recyclable refuse, comprising:

a vehicle having an elongated longitudinally extending bed in longitudinally spaced relation;

a plurality of containers transversely mounted to said bed;

one of said containers being a compacting container having a lift frame secured to said bed and wherein said compacting container is pivotally secured to said lift frame;

said compacting container including a body having a top portion, a floor, first and second ends, first and second sides, and a plurality of interior walls defining a refuse deposit area and a refuse compaction area;

a peaked roof disposed in said top portion;

a crossed-cylinder compactor ram within said body for transferring refuse from said deposit area into said compaction area and for causing compaction thereof;

a curbside refuse inlet disposed in said first end for depositing refuse therethrough;

a roof refuse inlet disposed in said top portion adjacent said second end for depositing refuse therethrough;

a fixed pivot disposed along the intersection of said second end and said top portion;

a discharge door secured to said fixed pivot extending therefrom to a lower edge which contacts said floor when closed;

a dumper basket cooperatively secured with said door to said fixed pivot for depositing refuse through said roof refuse inlet;

a stop bar secured to said lift frame; and a latch plate pivotally secured to said floor adjacent said second end and having upper and lower edges which locks said discharge door in a closed position when said lower edge contacts said stop bar while said upper edge simultaneously contacts said discharge door.

18. A mobile system for collection of recyclable refuse, comprising:

a) a vehicle;

b) a hollow container mounted to said vehicle;

c) a first refuse inlet disposed in an end of said container for depositing refuse therethrough;

d) a second refuse inlet disposed in the top of said container for depositing refuse therethrough;

e) a discharge door pivotally secured to said container;

f) a basket pivotally secured to said container for depositing refuse through said second refuse inlet;

g) said container is pivotally mounted to said vehicle; and h) an automatic latch lockingly secures said discharge door in a closed position, said latch includes a stop bar secured to said vehicle and a latch plate pivotally mounted to said container and having an upper edge and a lower edge so that said door is locked in a closed position when said lower edge contacts said stop bar while said upper edge simultaneously contacts said door.

19. A mobile system for collection of recyclable refuse, comprising:

a) a vehicle;

b) a hollow container mounted to said vehicle;

c) a first refuse inlet disposed in an end of said container for depositing refuse therethrough;

d) a second refuse inlet disposed in the top of said container for depositing refuse therethrough;

e) a discharge door pivotally secured to said container;

f) a basket pivotally secured to said container for depositing refuse through said second refuse inlet;

g) a link having first and second end portions; and h) a cylinder and piston assembly having first and second ends, said first end is pivotally secured to said door and said second end is pivotally secured to said first end portion and said second end portion is secured to said basket.

* * * * *